US008210464B1

(12) United States Patent
Selby

(10) Patent No.: US 8,210,464 B1
(45) Date of Patent: Jul. 3, 2012

(54) DEVICE FOR STORING AND DISPENSING FLEXIBLE TUBING

(76) Inventor: William J. Selby, Stoughton, MA (US)

( * ) Notice: Subject to any disclaimer, the term of this patent is extended or adjusted under 35 U.S.C. 154(b) by 242 days.

(21) Appl. No.: 12/786,715

(22) Filed: May 25, 2010

(51) Int. Cl.
*B65H 23/04* (2006.01)

(52) U.S. Cl. ..... 242/615.4; 242/588.3; 242/588.4; 242/588.6; 206/395

(58) Field of Classification Search .... 242/588.3–588.4, 242/588.6, 129, 615.4; 206/395, 409
See application file for complete search history.

(56) References Cited

U.S. PATENT DOCUMENTS 1,826,084 A * 10/1931 Mohr ..... 242/137.1
3,680,810 A * 8/1972 Jarmalow ..... 242/171
3,693,784 A * 9/1972 Holmes ..... 206/409
5,246,111 A * 9/1993 Shibazaki et al. ..... 206/409
5,826,817 A 10/1998 Selby
D503,337 S 3/2005 Selby
D509,147 S 9/2005 Selby
D626,429 S * 11/2010 Selby ..... D9/715
D638,721 S * 5/2011 Selby ..... D9/715

* cited by examiner

*Primary Examiner* — Sang Kim
(74) *Attorney, Agent, or Firm* — Steven N. Fox, Esq

(57) ABSTRACT

The present invention is a device used for storing, displaying, and dispensing flexible tubing on a store shelf. The device comprises a bottom wall having a front edge, a rear wall, and first and second sidewalls. The device further comprises flexible tubing wrapped about a spool assembly mounted to and spanning the first and second sidewalls. The device further comprises a bumper removably engaged with the front edge of the bottom wall. The bumber reduces slipping and damage to the device when the flexible tubing is dispensed by the customer.

5 Claims, 6 Drawing Sheets

DEVICE FOR STORING AND DISPENSING FLEXIBLE TUBING

BACKGROUND OF THE INVENTION

Various types of devices have been developed for storing, displaying, and dispensing and storing of materials such as flexible tubing. U.S. Pat. No. 5,826,817 discloses a cardboard box having a bottom wall, sidewalls, a front end wall with a window, a rear end wall, and a spool member spanning from sidewall to sidewall. Flexible tubing is wrapped around the spool member and dispensed thru the window. Such conventional devices have enjoyed considerable success. However, such conventional devices often slip on the shelf when the tubing is pulled by the customer causing damage to the front of the cardboard box. Another disadvantage with conventional devices is that a significant amount of material is employed increasing the overall cost of the device.

SUMMARY OF THE INVENTION

One object of the present invention to provide a device for storing, displaying, and dispensing flexible tubing on a store shelf that will resist slipping and damage when the flexible tubing is dispensed by the customer.

Another object of the present invention is to provide a device for storing, displaying, and dispensing flexible tubing that uses less material and is significantly less expensive to manufacture than conventional devices.

The present invention is a device used for storing and dispensing flexible tubing on a store shelf. In one embodiment, the device comprises a bottom wall, a rear wall, a first sidewall and a second sidewall. The device further comprises flexible tubing disposed about a spool assembly mounted to and spanning the first and second sidewalls. The bottom wall comprises a front edge. The device further comprises a bumper engaged with the front edge of the bottom wall. The bumper provides frictional support to the device to reduce slipping during dispensing of the flexible tubing thereby making dispensing easier for the customer. The sidewalls each comprise sloped walls that reduce the amount of material and overall cost required for manufacturing the device.

BRIEF DESCRIPTION OF THE DRAWINGS

The following description of the invention shall be further understood with reference to the accompanying drawings, in which.

DETAILED DESCRIPTION OF INVENTION

Figure 1:
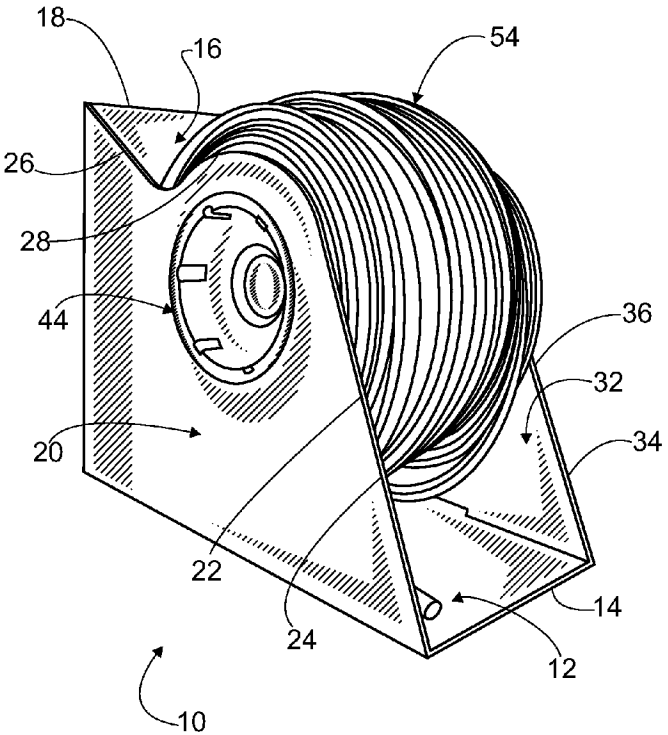
FIG. 1 is a perspective view of a device according to the present invention with flexible tubing fully wound upon the spool assembly.
Figure 2:
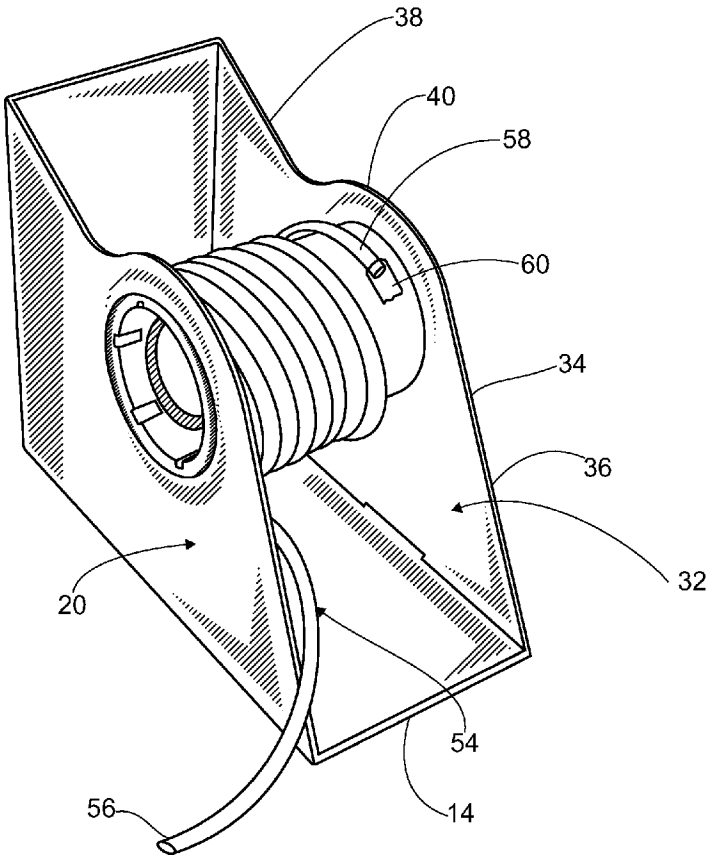
FIG. 2 is a perspective view of the device shown with the flexible tubing substantially dispensed.

Referring to FIGS. 1 and 2, the present invention is a device 10 for storing, displaying, and dispensing articles such as flexible tubing 54 on a store self (not shown). Device 10 generally comprises a bottom wall 12, a rear wall 16, a first side wall 20 and a second side wall 32. Device 10 further comprises flexible tubing 54 rolled about a spool assembly 44 connected to and spanning sidewalls 20 and 32. Bottom wall 12 further comprises a front edge 14. Rear wall 16 further comprises an outside edge 18. First and second sidewalls 20 and 32 further comprise outside edges 22 and 34, respectively. Device 10 further comprises a stop member 62 engaged with front edge 14 of bottom wall 12. First and second sidewalls 20 and 32 extend upward from bottom wall 12 and are substantially perpendicular to rear wall 16. Outside edge 22 of first sidewall 20 further comprises a leading straight edge portion 24, a trailing straight edge portion 26, and a curved edge portion 28. Curved edge portion 28 is disposed between leading and trailing straight edge portions 24 and 26. Outside edge 34 of second sidewall 32 further comprises a leading straight edge portion 36, a trailing straight edge portion 38, and a curved edge portion 40. Curved edge portion 40 is disposed between leading and trailing straight edge portions 36 and 38. As will be described with reference to FIG. 6, bottom wall 12, rear wall 16, first and second sidewalls 20 and 32 may be formed from a single sheet of cardboard.

Flexible tubing 54 further comprises an inside end 58 and an outside end 56. Inside end 58 is attached to spool assembly 44 by a fastener 60. In the embodiment shown, fastener 60 is a piece of adhesive tape. In other embodiments, fastener 60 may be staples or any other well known type of fastener.

Device 10 may employ products other than flexible tubing 54. By way of example only, device 10 may employ a rope, a chain, a wire or wall paper, or any other elongated flexible product suited for dispensing from a spool.

Figure 3:
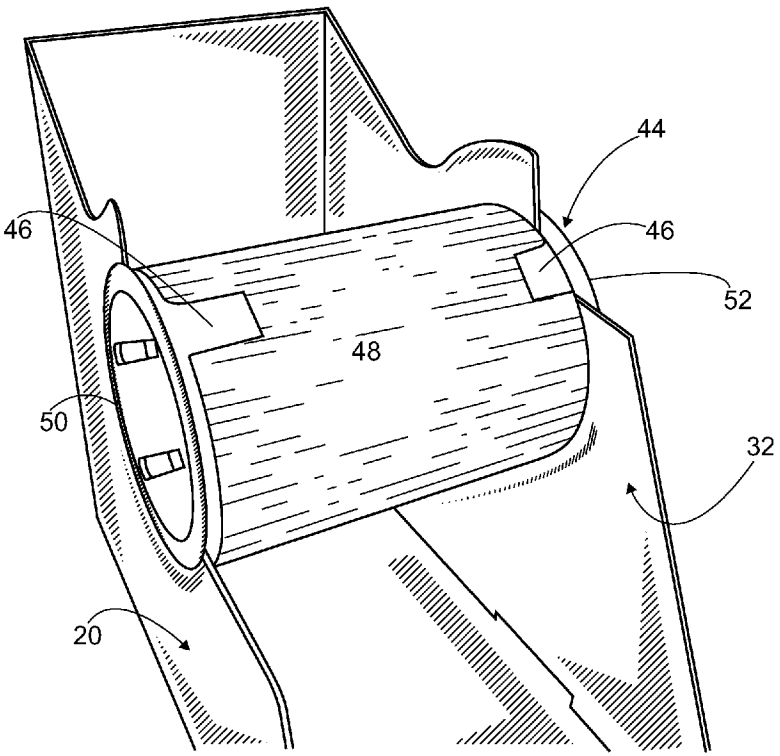
FIG. 3 is a perspective view of the device shown with the left and right sidewalls partially removed to show the spool assembly.

Referring to FIG. 3, spool assembly 44 comprises an inner spool 46, an outer spool 48, a left flange 50 and a right flange 52. Left and right flanges 50 and 52 are engaged with the open ends of inner spool 46 thru openings 30 and 42 of first and second sidewalls 20 and 32, respectively. Outer spool 48 freely rotates about inner spool 46. Flexible tubing 54 is wrapped about outer spool 48 toward a substantially radial position outward of leading and trailing straight edge portions 24 and 26 of first sidewall 20 and of leading and trailing straight edge portions 36 and 38 of second sidewall 32.

Figure 4:
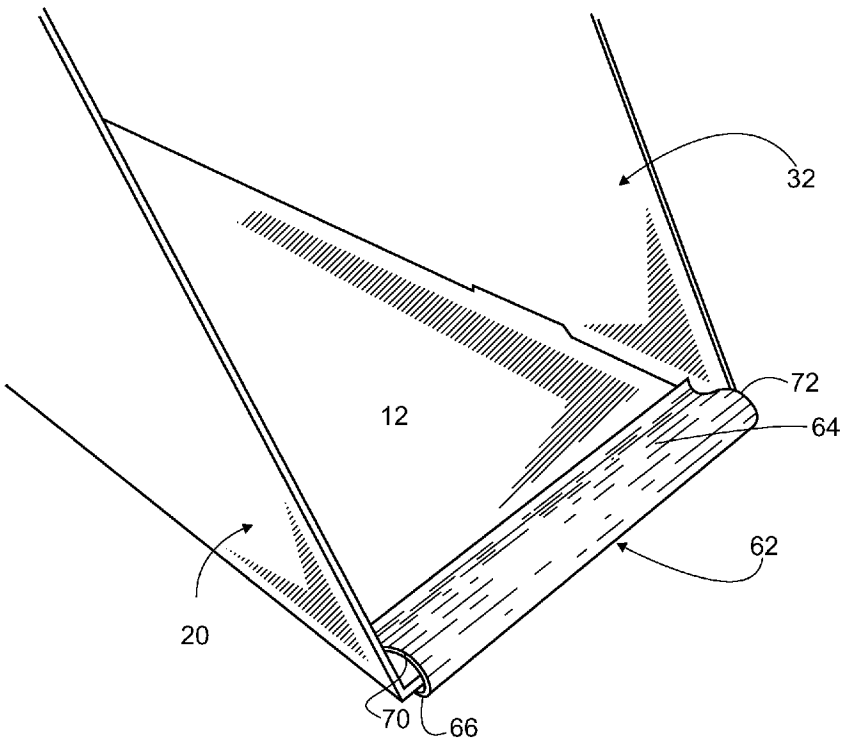
FIG. 4 is a perspective view of the device showing a bumper engaged with a front edge of the bottom wall.
Figure 5:
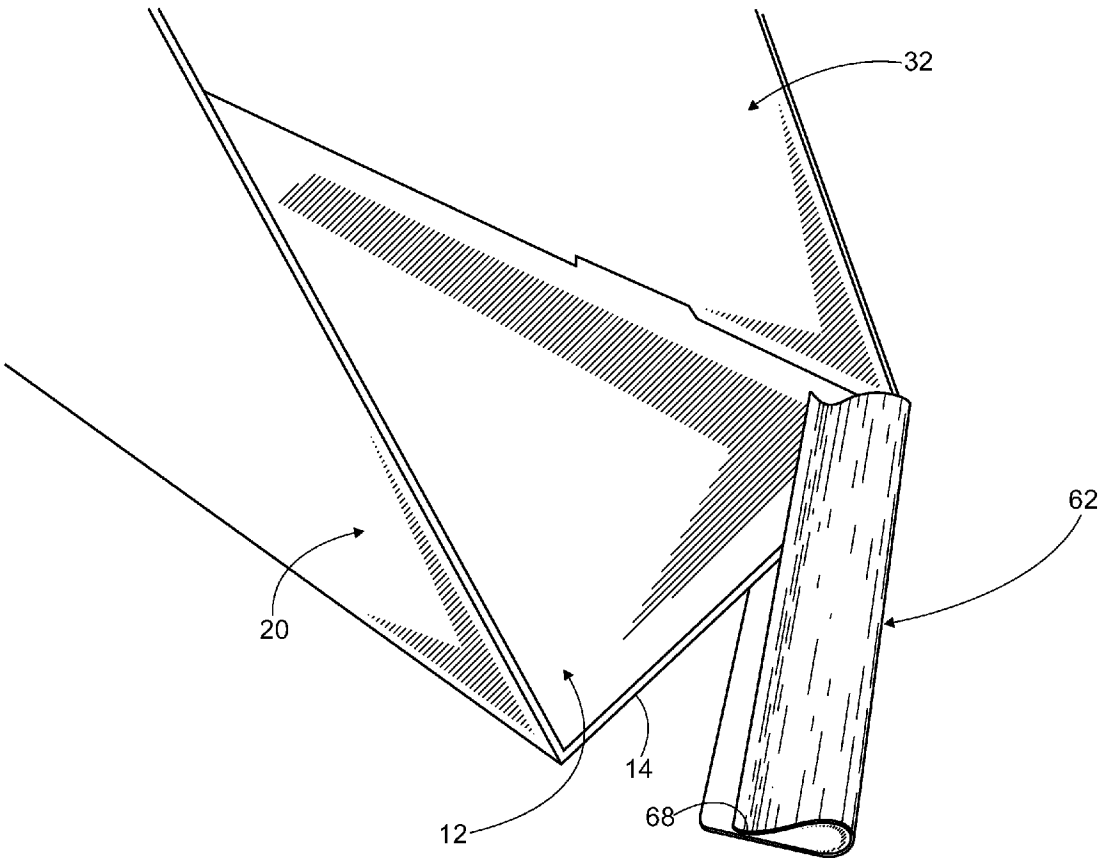
FIG. 5 is a perspective view of the device showing a bumper partially removed from the front edge of the bottom wall.

Referring to FIGS. 4 and 5, bumper 62 extends along front edge 14 of bottom wall 12 from first sidewall 20 to second sidewall 32. Bumper 62 is made from a flexible material such as, but not limited to, rubber or plastic. Bumper 62 further comprises an upper wall 64, a lower wall 66, a channel 68, a first end 70 and a second end 72. As shown in FIG. 5, bumper 62 engages front edge 14 of bottom wall 12 between upper wall 64 and lower wall 66 thru channel 68. Bumper 62 provides frictional support to device 10 against the pulling force applied by a customer when dispensing flexible tubing 54 (FIG. 1). Bumper 62 also prevents damage to front edge 14 of bottom wall 12. Bumper 62 may take different forms. By way of example only, bumper 62 may employ multiple pieces engaged with front edge 14 rather than one-piece.

Figure 6:
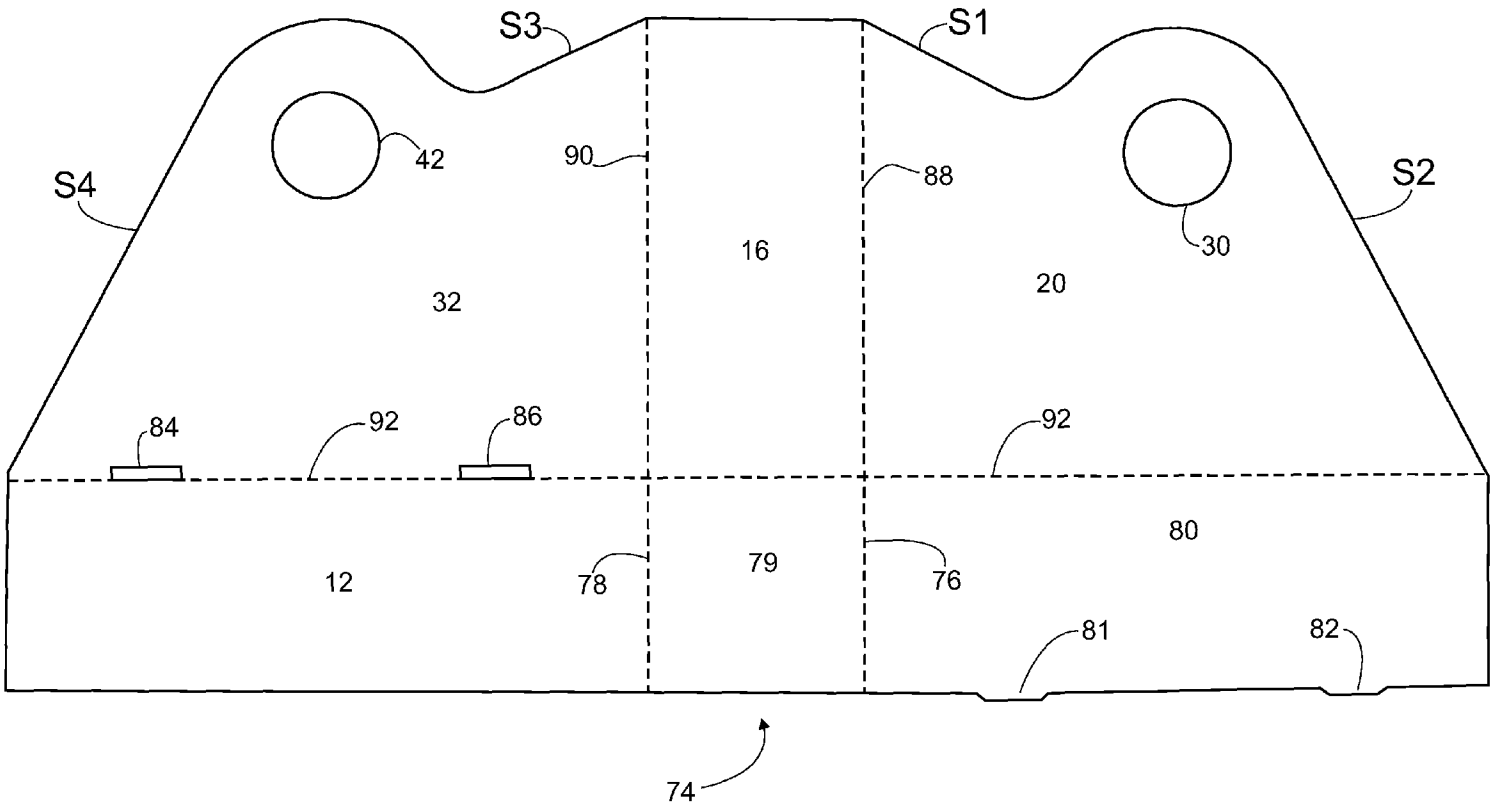
FIG. 6 is a top plan view of a cardboard sheet of the present invention showing various cut and fold lines needed to form the one piece box or housing.

Referring to FIG. 6, device 10 is made from a single cardboard sheet 74 having various cut-lines and fold lines which allow sheet 74 to be folded to the desired shape. Sheet 74 comprises a first cut line 76, a second cut line 78, a rear wall flap 79, a bottom wall flap 80, a first tab 81, a second tab 82, a first slot 84, a second slot 86, a first vertical fold line 88, a second vertical fold line 90, a horizontal fold line 92. Device 10 is created by pre-folding the cardboard sheet 74 along fold lines 88, 90 and 92. After pre-folding, cuts are made along cut lines 76 and 78. After cutting, sheet 74 is folded along fold lines 88, 90, and 92. Bottom wall flap 80 is then folded under bottom wall 12 and tabs 81 and 81 are secured to slots 84 and 86. Leading straight edge 24 of first sidewall 20 has a slope S1 and trailing straight edge 26 of first sidewall 20 has a slope S2. Slope S2 is larger than slope S1. Leading straight edge 36 of second sidewall 32 has a slope S3. Trailing straight edge 38 of second sidewall 32 has a slope S4. Slope S4 is larger than slope S3. The sloped walls of device 10 reduce the consumption of material and overall cost. The sloped walls of device 10 further provide structural stability during dispensing. Sheet 74 further comprises holes 42 and 30 which as previously described are cut into sidewalls 30 and 22, respectively.

While particular embodiments of the invention have been shown and described, it will be obvious to those skilled in the art that changes and modifications may be made without departing from the scope of the claimed invention.

What is claimed:

1. A device for storing and dispensing flexible tubing comprising:

(a) a bottom wall comprising a front edge;

(b) a rear wall extending upward from said bottom wall; said rear wall comprising an outside edge;

(c) a first sidewall extending upward from said bottom wall; said first sidewall is substantially perpendicular to said rear wall; said first sidewall comprises an outside edge; said outside edge comprises a leading straight edge portion, a trailing straight edge portion, and a curved edge portion; said first curved edge portion is disposed between said first leading and first trailing straight edge portions;

(d) a second sidewall extending upward from said bottom wall; said second sidewall is substantially perpendicular to said rear wall and parallel to said first sidewall; said second sidewall comprises an outside edge; said outside edge of said second sidewall comprises a leading straight edge portion, a trailing straight edge portion, and a curved edge portion; said curved edge portion is disposed between said leading and trailing straight edge portions;

(e) a spool assembly engaged with said first and second sidewalls;

(f) flexible tubing wrapped about said spool member to a radial position outward of said leading and trailing edges of said outside edges of said first and second sidewalls, respectively; and (g) a bumper engaged with said front edge of said bottom wall; said bumper extends substantially from said first sidewall to said second sidewall.

2. The device of claim 1, wherein said leading straight edge of said outside edge of said first sidewall has a slope S1; said trailing straight edge of said outside edge of said first sidewall has a slope S2 that is larger than said slope S1.

3. The device of claim 2, wherein said leading straight edge of said outside edge of said second sidewall has a slope S3; said trailing straight edge of said outside edge of said second sidewall has a slope S4 that is larger than said slope S3.

4. The device of claim 3, wherein said bumper is made from plastic.

5. The device of claim 4, wherein said first and second sidewalls and said bottom wall are made from a single piece of card board.

* * * * *